US006893272B2

(12) United States Patent
Yu

(10) Patent No.: US 6,893,272 B2
(45) Date of Patent: May 17, 2005

(54) ELECTRICAL CONNECTOR ASSEMBLY HAVING IMPROVED GROUNDING MEANS

(75) Inventor: Hung-Chi Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/946,180

(22) Filed: Sep. 20, 2004

(65) Prior Publication Data

US 2005/0064744 A1 Mar. 24, 2005

(30) Foreign Application Priority Data

Sep. 19, 2003 (TW) ..... 92216894 U

(51) Int. Cl.[7] ..... H01R 9/09
(52) U.S. Cl. ..... 439/79; 439/608
(58) Field of Search ..... 439/79, 80, 101, 439/108, 608, 609, 610

(56) References Cited

U.S. PATENT DOCUMENTS 4,869,677 A 9/1989 Johnson et al.
5,342,211 A * 8/1994 Broeksteeg ..... 439/108
5,356,301 A 10/1994 Champion et al.
5,433,618 A 7/1995 Morlion et al.
5,934,939 A * 8/1999 Thenaisie et al. ..... 439/607
6,109,933 A 8/2000 Lenoir et al.
6,299,484 B2 * 10/2001 Van Woensel ..... 439/608
6,361,366 B1 * 3/2002 Shuey et al. ..... 439/608
6,520,803 B1 * 2/2003 Dunn ..... 439/608

* cited by examiner

*Primary Examiner*—Thanh-Tam Le
(74) *Attorney, Agent, or Firm*—Wei Te Chung

(57) ABSTRACT

An electrical connector assembly (3) includes a header and a receptacle connectors (1,2). The header connector comprises a header housing (10) and a ground contact plate (11). The header housing has a base (100), a pair of sidewalls (101,102) extending from the base, and a mating space (103) formed between the sidewalls. The ground contact plate is attached to one of the sidewalls. The receptacle connector includes a receptacle housing (20) inserted into the mating space of the header housing, and a shield member (21) covering the receptacle housing. The ground contact plate has a contact beam (115) extending into the mating space through a notch (105) in the one sidewall along the insertion direction of the receptacle connector and contacting the shield member.

7 Claims, 7 Drawing Sheets

ELECTRICAL CONNECTOR ASSEMBLY HAVING IMPROVED GROUNDING MEANS

BACKGROUND OF THE INVENTION

1. Field of the Invention

The present invention relates to an electrical connector assembly, and particularly to an electrical connector assembly having an improved grounding means.

2. Description of Related Art

It is common in electronic industry to provide a header connector having a plurality of male pins and mounted on a mother board, and a receptacle connector mounted on a daughter board. The receptacle connector has a plurality of receptacle contacts for electrically connecting with the male pins of the header connector. It is also known to shield the header and the receptacle connectors for protection from Electro-Magnetic Interference (EMI). For example, U.S. Pat. No. 5,433,618 shows such an electrical connector assembly comprising a header and a receptacle connectors. The header connector comprises a header housing having a bottom wall and two opposite side walls, a plurality of contact pins attached on the bottom wall, and header shielding plates mounted on the side walls. The header shielding plates have contact springs projecting into the header housing through openings in the side walls. The receptacle connector comprises a receptacle housing, a plurality of female contact elements mounted in the receptacle housing, and a receptacle shielding plate having a long and a short legs extending along an upper and a back side of the receptacle housing, respectively. When the receptacle connector is inserted into the header housing, the contact springs contact the receptacle shielding plate.

However, the contact springs of the header shielding plates extend in a direction opposite to the insertion direction of the receptacle connector, which increases insertion resistance of the receptacle connector, thereby adversely affecting a reliable mating between the header and the receptacle connectors.

Hence, an electrical connector assembly having an improved grounding means is desired.

SUMMARY OF THE INVENTION

An object of the present invention is to provide an electrical connector assembly having an improved grounding means which can reduce insertion resistance between a header and a receptacle connectors thereof.

To achieve the above object, an electrical connector assembly in accordance with the present invention comprises a header and a receptacle connectors. The header connector comprises a header housing and a ground contact plate. The header housing has a base, a pair of sidewalls extending from the base, and a mating space formed between the sidewalls. The ground contact plate is attached to one of the sidewalls. The receptacle connector comprises a receptacle housing inserted into the mating space of the header housing, and a shield member covering the receptacle housing. The ground contact plate has a contact beam extending into the mating space through a notch in the one sidewall along the insertion direction of the receptacle connector and contacting the shield member.

Other objects, advantages and novel features of the invention will become more apparent from the following detailed description when taken in conjunction with the accompanying drawings.

DETAILED DESCRIPTION OF THE INVENTION

Figure 7:
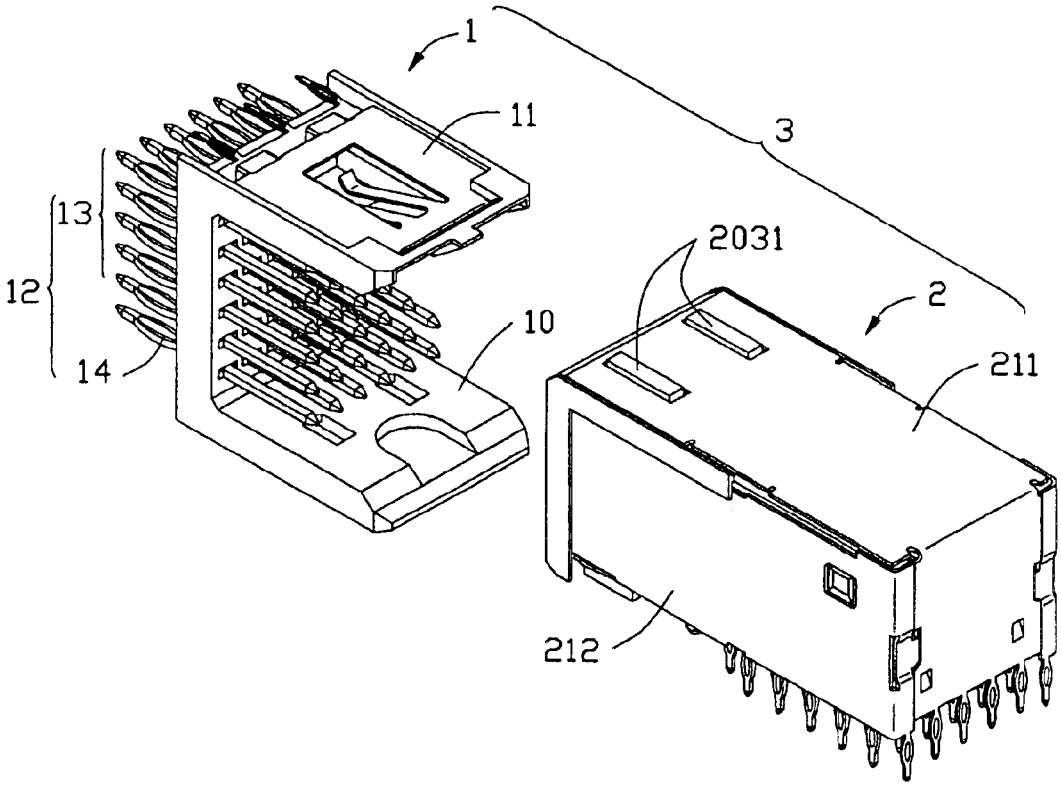
FIG. 7 is a perspective view of the electrical connector assembly in accordance with the present invention.

Referring to FIG. 7, an electrical connector assembly 3 in accordance with the present invention comprises a header connector 1 and a receptacle connector 2.

Figure 1:
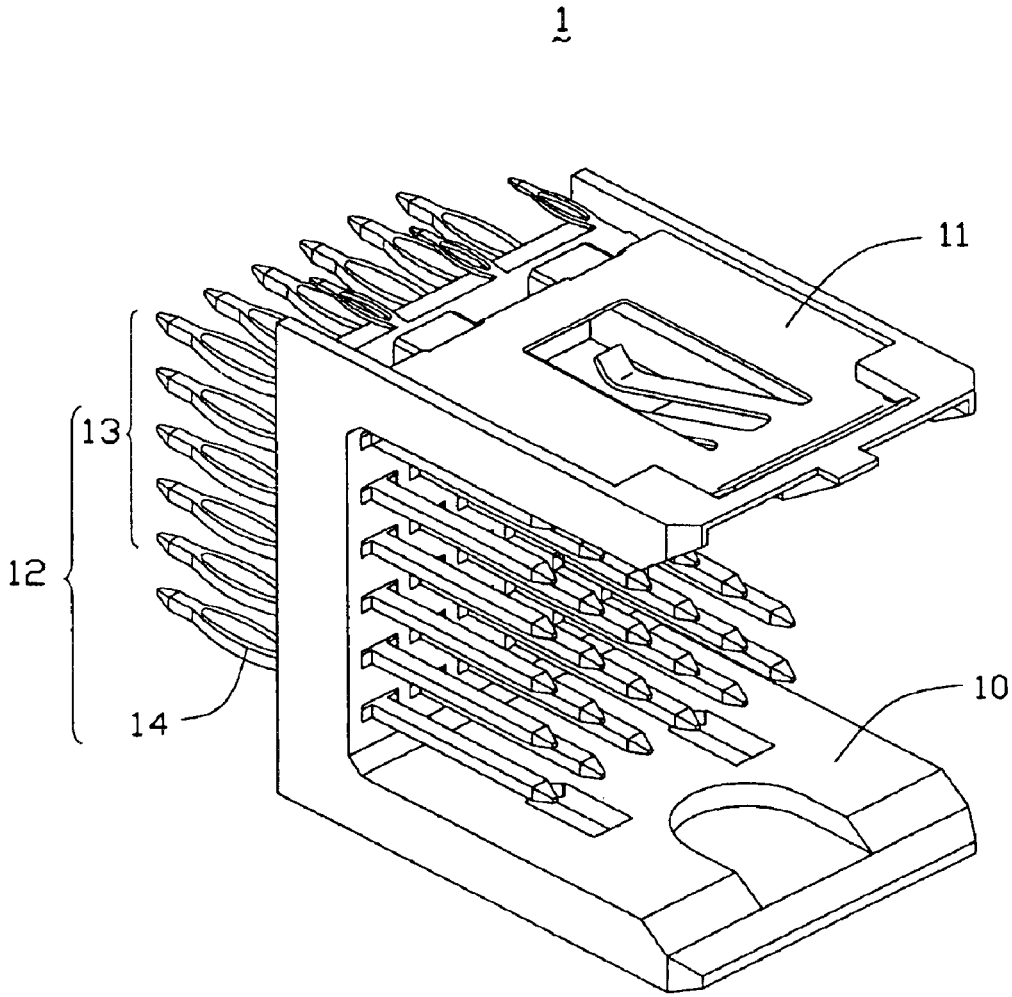
FIG. 1 is a perspective view of a header connector of an electrical connector assembly in accordance with the present invention.
Figure 2:
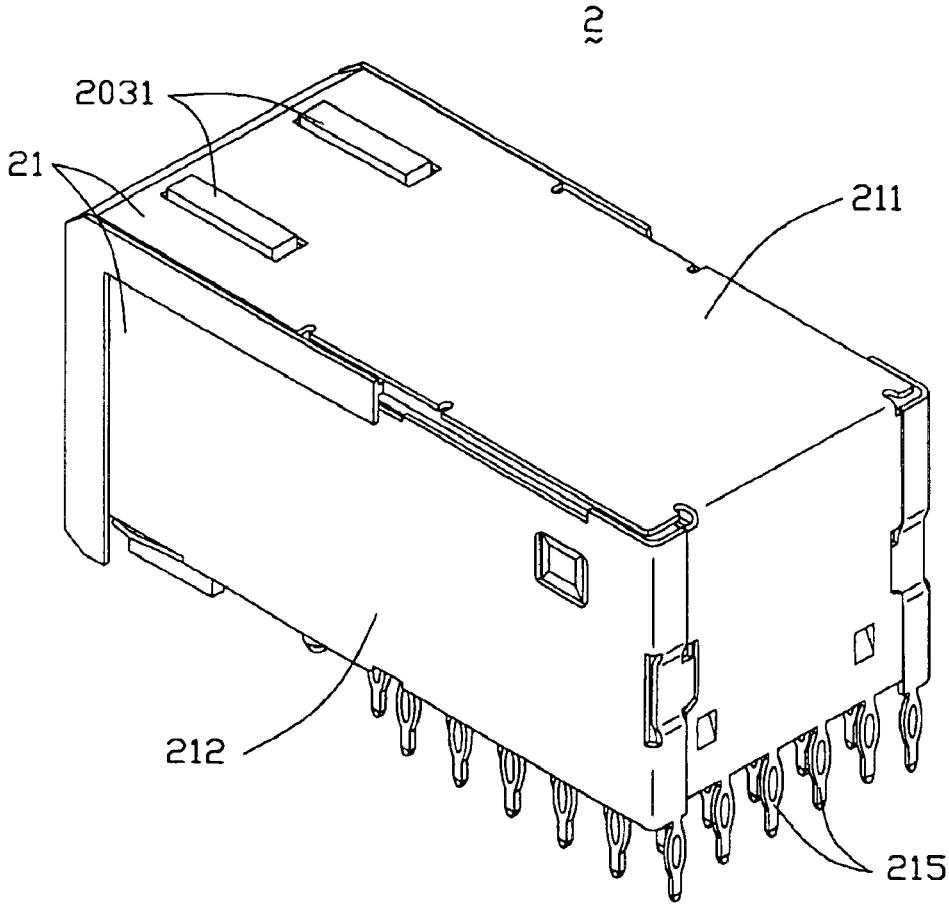
FIG. 2 is a perspective view of a receptacle connector of the electrical connector assembly.
Figure 3:
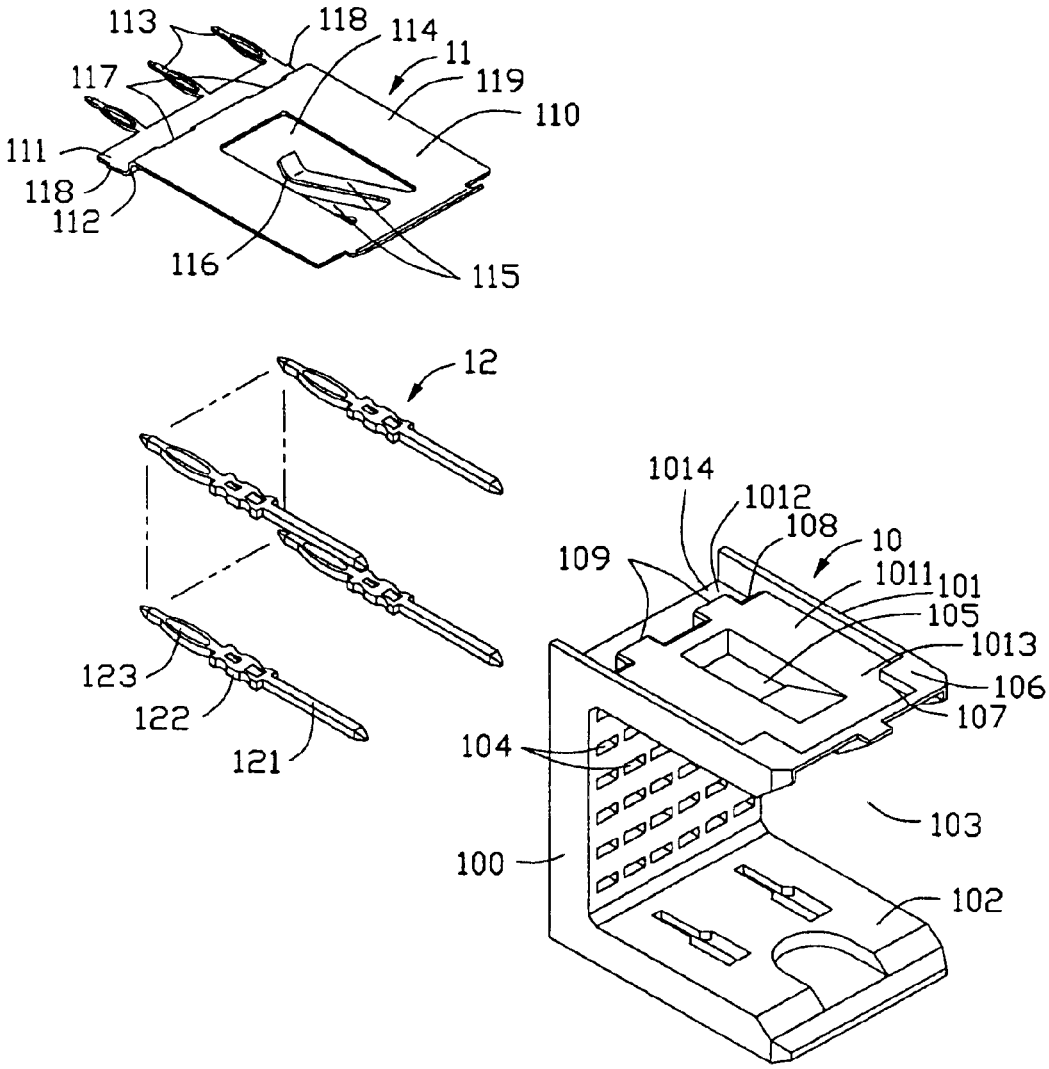
FIG. 3 is an exploded perspective view of the header connector of FIG. 1.
Figure 4:
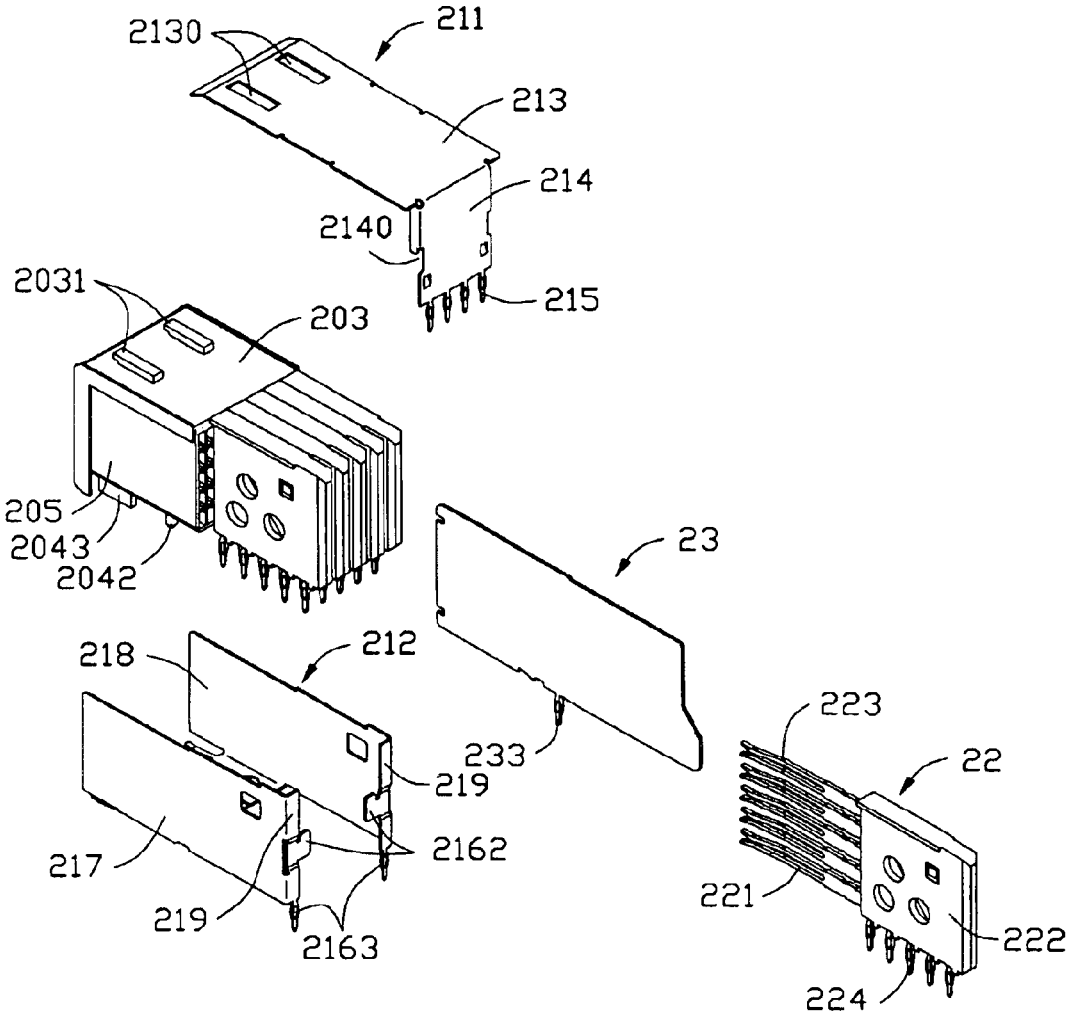
FIG. 4 is an exploded perspective view of the receptacle connector of FIG. 2.
Figure 5:
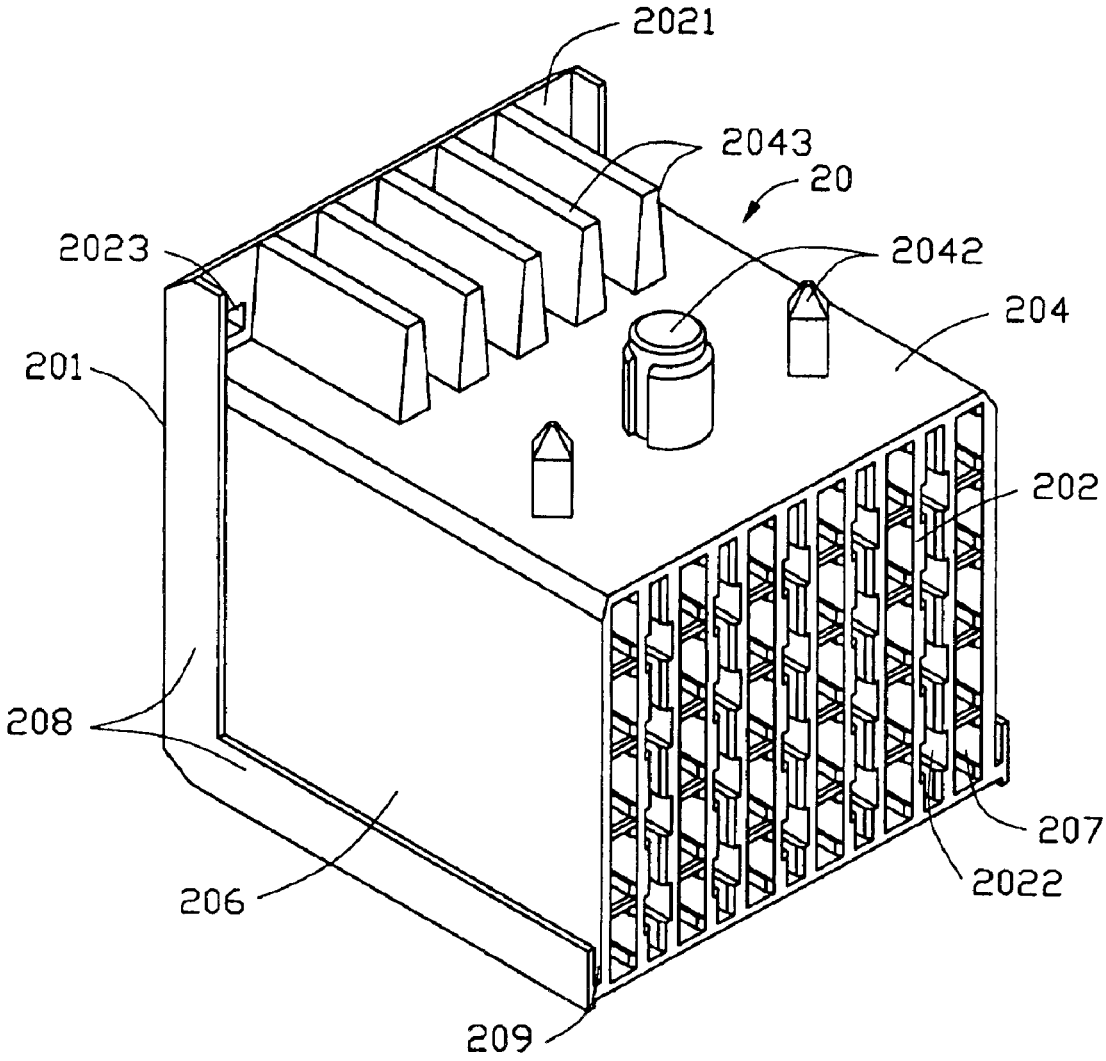
FIG. 5 is a perspective view of a receptacle housing of the receptacle connector of FIG. 4 but taken from another aspect.
Figure 6:
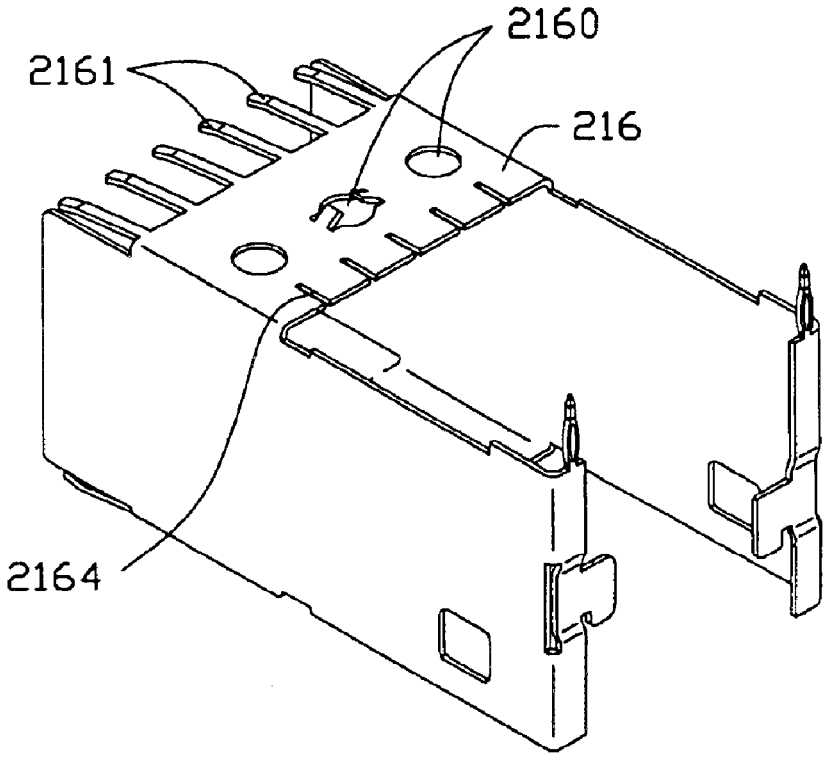
FIG. 6 is a perspective view of a lower shell of the receptacle connector of FIG. 5 but taken from another aspect.

Referring to FIGS. 1 and 3, the header connector 1 comprises a header housing 10, a ground contact plate 11, and a plurality of header contacts 12. The header housing 10 comprises a base 100 and an upper and a lower sidewalls 101, 102 extending forwardly from an upper and a lower ends of the base 100. A mating space 103 is formed between the upper and the lower sidewalls 101, 102. The base 100 defines a plurality of rows of mounting apertures 104 therethrough in a mating direction of the header connector 1. The upper sidewall 101 defines a recess 1011 and a depression 1012 in an upper face (not labeled) thereof. The depression 1012 is located behind the recess 1011. A bottom surface 1014 of the depression 1012 is downwardly offset from the bottom surface 1013 of the recess 1011. A step surface 108 is formed between the recess 1011 and the depression 1012. A pair of extensions 109 extend rearwardly from the step surface 108. A notch 105 is defined in the bottom surface 1013 of the recess 1011 and communicating with the mating space 103. The upper sidewall 101 is formed with a pair of blocks 106 on opposite sides thereof and adjacent a front end thereof. A pair of slits 107 are formed between the blocks 106 and the bottom surface 1013 of the recess 1011.

The ground contact plate 11 is stamped from a metal plate and comprises a body portion 110, a pair of contact beams 115, and a plurality of press-fit solder portions 113. The body portion 110 comprises a main plate 119, a connect portion 112 bent downwardly from a rear end of the main plate 119, and a retention plate 111 extending rearwardly from the connect portion 112. The contact beams 115 extend rearwardly and downwardly from a front end of the main plate 119. A curved portion 116 is formed on a free end of each contact beam 115 to function as a contact portion. The connect portion 112 defines a pair of openings 117. The retention plate 111 is formed with pair of barbs 118 on opposite sides thereof. The solder portions 113 extending rearwardly from a rear end of the retention plate 111. When the ground contact plate 11 is attached to the header housing 10, the main plate 119 is accommodated in the recess 1011 with opposite sides of the front end thereof received in the slits 107, the connect portion 112 covers the step surface 108 with the extensions 109 extending through the openings 117, the retention plate 111 is received in the depression 1012 with the barbs 118 engaged with opposite end walls of the depression 1012. Thus, the ground contact plate 11 is reliably secured to the header housing 10. The contact beams 115 extend into the mating space 103 through the notch 105. The solder portions 113 extend rearwardly beyond a rear face of the header housing 10 for soldering to a mother board on which the header connector 1 is mounted.

The header contacts 12 comprises a plurality of signal contacts 13 and a plurality of ground contacts 14. Each of the signal and the ground contacts 13, 14 comprises a retention portion 122 interferentially fitted in the mounting aperture 104 of the header housing 10, a mating portion 121 extending forwardly from the retention portion 122 and into the mating space 103, and a press-fit tail portion 123 extend rearwardly from the retention portion 122 and beyond the rear face of the header housing 10. The ground contacts 14 are mounted in the lowest row of the mounting apertures 104.

Referring to FIGS. 2 and 4–7, the receptacle connector 2 comprises a receptacle housing 20, a plurality of contact units 22, a plurality of cross-talk shield plate 23, and a shield member 21. The receptacle housing 20 has a front face 201, a rear face 202 opposite to the front face 201, an upper face 203, a lower face 204 opposite to the upper face 203, and two opposite side faces 205, 206. The receptacle housing 20 defines a plurality of columns of passageways 207 extending from the front face 201 to the rear face 202. A channel 2022 is defined between every two adjacent columns of the passageways 207. The channel 2022 extends forwardly from the rear face 202 but not throughout the front face 201. A pair of projections 2031 are formed on the upper face 203 of the receptacle housing 20. The receptacle housing 20 is formed with a pair of fringes 208 on opposite sides thereof. A pair of slots 209 are formed between the fringes 208 and the side faces 205, 206. A lower wall 2021 extends downwardly from a lower edge of the front face 201 and defines a row of through holes 2023 therethrough in a mating direction of the receptacle connector 2. The receptacle housing 20 is formed with a rib 2043 adjacent a front end of the lower face 204 and connecting with the lower wall 2021 between every two adjacent through holes 2023. A plurality of posts 2042 extend downwardly adjacent a rear end of the lower face 204.

Each contact unit 22 comprises an insulator 222 and a plurality of receptacle contacts 221 insert molded in the insulator 222. Each receptacle contact 221 comprises a contact portion 223 extending forwardly beyond a front edge of the insulator 222, a press-fit tail portion 224 extending downwardly beyond a lower edge of the insulator 222, and a middle portion (not shown) connecting with the contact portion 223 and the tail portion 224 and embedded in the insulator 222.

Each cross-talk shield plate 23 is stamped from a metal plate and comprises a press-fit solder portion 233 extending downwardly from a lower edge thereof.

The shield member 21 comprises an upper shell 211 and a lower shell 212. The upper shell 211 comprises a top wall 213, a rear wall 214 extending downwardly from a rear edge of the top wall 213, and a plurality of press-fit solder portions 215 extending downwardly from a lower edge of the rear wall 214. The top wall 213 defines a pair of engaging openings 2130 in a front end thereof. The rear wall 214 defines a pair of gaps 2140 on opposite sides thereof. The lower shell 212 comprises a bottom wall 216, a pair of side walls 217, 218 extending upwardly forwardly and rearwardly from opposite edges of the bottom wall 216, and a pair of bent portions 219 bending toward each other from rear edges of the side walls 217, 218. The bottom wall 216 defines a plurality of holes 2160 therein. A plurality of spring fingers 2161 extend forwardly from a front edge of the bottom wall 216. The bottom wall 216 defines a plurality of cutouts 2164 on a rear edge thererof. Each bent portion 219 comprises a latch tab 2162 and a press-fit solder portion 2163.

In assembly of the receptacle connector 2, the contact units 22 are assembled to the receptacle housing 20 with the contact portions 223 of the receptacle contacts 221 received in the passageways 207, and with the front edges of the insulator 222 abutting against the rear face 202 of the receptacle housing 20. Each of the cross-talk shield plates 23 is assembled to the receptacle housing 20 with a front end thereof received in a corresponding channel 2022, with a rear end thereof located between two corresponding adjacent insulators 222, and with the solder portion 233 extending downwardly beyond the lower face 204 of the receptacle housing 20. The lower shell 212 is assembled to the receptacle housing 20 from the lower face 204. Front edges and upper edges of the side walls 217, 218 are received in the slots 209 of the receptacle housing 20. The posts 2042 extend downwardly through the holes 2160. The solder portions 233 of the cross-talk shield plates 23 extend downwardly through the cutouts 2164 of the lower shell 212. The spring fingers 2161 extend forwardly along the lower face 204 of the receptacle housing 20 and are separated from each other by the ribs 2043. The bent portions 219 cover rear edges of the opposite outermost insulators 2222 with the solder portions 2163 extending downwardly beyond the lower edges of the opposite outermost insulators 222 for soldering to grounding traces of a daughter board (not shown) on which the receptacle connector 2 is mounted. The upper shell 211 is assembled to the receptacle housing 20 with the top wall 213 covering the upper face 203 of the receptacle housing 20 and top edges of the insulators 222, and with the rear wall 214 covering the rear edges of the insulators 222. The projections 2031 of the receptacle housing 20 engage with the engaging openings 2130 of the top wall 213. The gaps 2140 of the rear wall 214 engage with the latch tabs 2162 of the lower shell 212. The solder portions 215 extend downwardly beyond the lower edges of the insulators 222 for soldering to the grounding traces of the daughter board. So, the receptacle housing 20 and the contact units 22 are fully shielded by the shield member 21 to be prevented from EMI.

When the header connector 1 is to be mated with the receptacle connector 2. A front end of the receptacle housing 20 is inserted into the mating space 103 of the header connector 1. Since the contact beams 115 extend in a direction along the insertion direction of the receptacle connector 2, insertion resistance of the receptacle connector 2 is reduced. The mating portions 121 of the signal contacts 13 are inserted into the passageways 207 and are mated with the contact portions 223 of the receptacle contacts 221. The mating portions 121 of the ground contacts 14 penetrate the through holes 2023 of the receptacle housing 20 and contact with the spring fingers 2161 of the lower shell 212. The curved portions 116 of the ground contact plate 11 abut against the top wall 213 of the upper shell 211 to electrically connect the ground contact plate 11 with the upper shell 211.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector assembly, comprising:

a header connector comprising:

a header housing comprising a base, an upper and a lower sidewalls extending forwardly from the base, and a mating space formed between the upper and the lower sidewalls, the upper sidewall defining a notch communicating with the mating space;

a plurality of header contacts mounted on the base of the header housing; and a ground contact plate attached on the upper sidewall of the header housing and comprising a contact beam rearwardly extending into the mating space through the notch; and a receptacle connector comprising:

a receptacle housing inserted into the mating space of the header housing;

a plurality of receptacle contacts received in the receptacle housing; and a shield member covering the receptacle housing and contacting the contact beam of the ground contact plate;

wherein the upper sidewall defines a pair of slits receiving opposite sides of a front end of the ground contact plate;

wherein the shield member comprises an upper shell having a top wall and a rear wall, and a lower shell having a bottom wall and a pair of side walls extending upwardly forwardly and rearwardly from opposite edges of the bottom wall;

wherein a pair of bent portions bending toward each other from rear edges of the side walls of the lower shell, each bent portion comprises a latch tab, which is engages with a gap of the rear wall of the upper shell; and wherein the bottom wall of the lower shell defines a hole, and the receptacle housing comprises a post extending through the hole.

2. The electrical connector assembly as claimed in claim 1, wherein the upper sidewall of the header housing defines a recess and a depression in an upper face thereof, and wherein the ground contact plate comprises a body portion having a main plate and a retention plate received in the recess and the depression, respectively.

3. The electrical connector assembly as claimed in claim 2, wherein the retention plate is formed with a pair of barbs, on opposite sides thereof, engaged with opposite end walls of the depression.

4. The electrical connector assembly as claimed in claim 1, wherein the ground contact plate defines an opening, and wherein the upper sidewall is formed with an extension extending through the opening.

5. The electrical connector assembly as claimed in claim 1 wherein the top wall of the upper shell defines an engaging opening, and wherein the receptacle housing is formed with a projection engaged with the engaging opening.

6. The electrical connector assembly as claimed in claim 1, wherein the receptacle housing defines a pair of slots on opposite sides thereof receiving front and upper edges of the side walls of the lower shell.

7. The electrical connector assembly as claimed in claim 1, wherein the lower shell comprises a plurality of spring fingers extending forwardly from the bottom wall, and wherein the header contacts of the header connector comprises a plurality of ground contacts electrically connecting with the spring fingers.

* * * * *